US009127492B2

(12) United States Patent
Friesen et al.

(10) Patent No.: US 9,127,492 B2
(45) Date of Patent: Sep. 8, 2015

(54) CABLE DRUM CONSTRUCTION OF DOOR LIFT MECHANISM FOR MULTIPLE HORIZONTAL PANEL GARAGE DOOR WITH DISPROPORTIONALLY HEAVY TOP PORTION

(75) Inventors: Raymond J. Friesen, Mississauga (CA); Surinder Sambhi, Etobicoke (CA)

(73) Assignee: Raynor Mfg. Co., Dixon, IL (US)

( * ) Notice: Subject to any disclaimer, the term of this patent is extended or adjusted under 35 U.S.C. 154(b) by 101 days.

(21) Appl. No.: 13/293,920

(22) Filed: Nov. 10, 2011

(65) Prior Publication Data

US 2013/0048232 A1 Feb. 28, 2013

Related U.S. Application Data

(60) Provisional application No. 61/526,519, filed on Aug. 23, 2011.

(51) Int. Cl.

| | |
|---|---|
| ***E06B 9/08*** | (2006.01) |
| ***E05D 15/00*** | (2006.01) |
| ***E05D 13/00*** | (2006.01) |

(52) U.S. Cl.

CPC ..... *E05D 13/1261* (2013.01); *E05Y 2201/618* (2013.01); *E05Y 2201/664* (2013.01); *E05Y 2900/106* (2013.01)

(58) Field of Classification Search

CPC ..... E05D 13/1261; E05Y 2201/618; E05Y 2201/664; E06B 9/60; E06B 9/15

USPC ..... 160/133, 188, 189, 201; 49/199

See application file for complete search history.

(56) References Cited

U.S. PATENT DOCUMENTS

| | | | | |
|---|---|---|---|---|
| 2,007,552 | A | | 7/1935 | Vetterlein |
| 2,314,015 | A | | 3/1943 | Parsons |
| 2,680,004 | A | | 6/1954 | Herker |
| 2,722,273 | A | | 11/1955 | Taylor |
| 2,855,162 | A | | 10/1958 | Schacht, Jr. |
| 3,095,922 | A | | 7/1963 | Frazier |
| 3,311,159 | A | * | 3/1967 | Stansberry ..... 160/189 |
| 3,756,585 | A | | 9/1973 | Mihalcheon |
| 4,034,932 | A | | 7/1977 | Ferch |
| 4,071,205 | A | | 1/1978 | Wieschel |
| 4,165,053 | A | | 8/1979 | Konig |
| 4,483,496 | A | | 11/1984 | Weinlich |
| 4,519,556 | A | | 5/1985 | Timoschuk |
| 4,882,806 | A | | 11/1989 | Davis |
| 5,103,890 | A | | 4/1992 | Cloutier |
| 5,239,777 | A | | 8/1993 | Husselton |
| 5,259,433 | A | * | 11/1993 | Cloutier ..... 160/190 |
| 5,335,883 | A | * | 8/1994 | Mawer ..... 242/602.1 |
| 5,400,721 | A | | 3/1995 | Greene |
| 5,803,149 | A | | 9/1998 | Halley et al. |
| 5,829,737 | A | | 11/1998 | Gersemsky |

(Continued)

*Primary Examiner* — Katherine Mitchell
*Assistant Examiner* — Jeremy Ramsey
(74) *Attorney, Agent, or Firm* — Banner & Witcoff, Ltd.

(57) ABSTRACT

A cable lift mechanism for a multi panel, overhead garage door includes a drum having a spiral groove comprised of two adjacent sections that are generally coaxial with the longitudinal axis of the cable drum. The groove or grooves in a first section adjacent the attachment end of the cable to the drum have a lesser radius than the remaining grooves of the second section of the drum which have substantially equal radii of greater diameter than the first section radii. As a consequence, initial torque associated with lifting of a garage door is increased to lift a heavier upper or top panel or panels of a multi-panel garage door.

2 Claims, 3 Drawing Sheets

(56) References Cited

U.S. PATENT DOCUMENTS

| | | | | |
|---|---|---|---|---|
| 5,865,235 | A | 2/1999 | Krupke et al. | |
| 6,019,353 | A | 2/2000 | Atfield | |
| 6,134,835 | A | 10/2000 | Krupke et al. | |
| 6,164,014 | A | 12/2000 | McDowell et al. | |
| 6,374,543 | B1 | 4/2002 | Bishai | |
| 6,401,793 | B1 | 6/2002 | Martin | |
| 6,408,925 | B1 | 6/2002 | Dorma | |
| 6,442,897 | B1 | 9/2002 | Mullet | |
| 6,561,256 | B2 | 5/2003 | Mullet | |
| 6,601,794 | B2 | 8/2003 | Brutschin | |
| 6,616,091 | B2 | 9/2003 | Priest et al. | |
| 7,343,958 | B1 | 3/2008 | East et al. | |
| 8,162,026 | B1 * | 4/2012 | Lundahl | 160/191 |
| 2002/0066231 | A1 | 6/2002 | Hormann | |
| 2002/0157797 | A1 | 10/2002 | Mullet | |
| 2003/0062441 | A1 * | 4/2003 | Priest et al. | 242/602.1 |
| 2003/0192254 | A1 | 10/2003 | Brookbank et al. | |
| 2008/0196844 | A1 * | 8/2008 | Diaz | 160/191 |

* cited by examiner

CABLE DRUM CONSTRUCTION OF DOOR LIFT MECHANISM FOR MULTIPLE HORIZONTAL PANEL GARAGE DOOR WITH DISPROPORTIONALLY HEAVY TOP PORTION

A RELATED APPLICATION

This is a utility application incorporating by reference and claiming priority to previously filed and provisional patent application Ser. No. 61/526,519 filed Aug. 23, 2011 entitled Cable Drum Construction for Multiple Horizontal Panel Garage Door Lift Assembly.

BACKGROUND OF THE INVENTION

In a principal aspect the present invention relates to a cable drum construction for a multiple panel garage door lift assembly. Garage doors, industrial doors and other closures for building openings may include multiple horizontal panels which are hinged together and collectively mounted on a track to enable movement of the multiple, pivotally connected panels between an open position and a closed position. To facilitate movement between and an open and a closed position, a motorized lift assembly or mechanism is typically provided. The lift assembly may include a spring biased cable arrangement which facilitates movement of the multiple, articulated, horizontal panels between the open and closed positions along a track.

Such lift assembly constructions or mechanisms thus may include a cable affixed to a lower panel of a door and wound on a drum attached to a spring biased torsion rod mounted on the frame or header for the door. The design of these constructions is well-known and the design of cable drums associated with such constructions has been the subject matter of various known developments including the disclosure in U.S. Pat. No. 7,343,958 issued Mar. 18, 2008 entitled Overhead Door Lift System, incorporated herewith by reference.

While cable door lift assembly designs have evolved over time, there remains a problem that has not been specifically addressed heretofore. That is, multi-panel doors conventionally comprise horizontal, hinged panels wherein all panels are of generally equal size, design and weight. For example, four identical panels may be arranged in an articulated or hinged array resulting in equal distribution of weight. Such constructions can be easily balanced for full travel along a track. However, often the first turn of a cable drum for such a multi-panel door includes a greater radius designed to decrease the initial spring lifting force and thereby make the closed door heavier and consequently assist maintaining the door in a vertical, fully closed position.

However, with many doors the top panel or section is heavier and as a consequence, the multiple sections of the door do not balance properly because torque per turn of the biasing door support spring is constant but the rate of change of the door weight is not constant. For example, the top section may be glazed, that is, include window panels incorporated therewith. Also the top panel may have a height dimension which is greater than the remaining door panel. Such glazing or extra height may cause a top panel to be heavier than the remaining sections or panels of the door. Therefore known prior art designs are not suitable to properly balance a door that comprises a heavier top panel or section. Further, once that top or heavier panel section rises into the horizontal position on the door track, that panel becomes less consequential with respect to movement of the entire assembly of door panels to the fully opened position. Thus, to accommodate an arrangement for lifting which includes a heavy top panel of a multi-panel door, is a problem that faces manufacturers of such panel doors.

SUMMARY OF THE INVENTION

Briefly the present invention comprises a multi-panel door, spring biased lift assembly and, in particular, the construction of a drum associated with such a spring biased lift assembly. For example, a lift assembly of the type generally shown in U.S. Pat. No. 7,343,958 discloses a spring lift assembly for a multi-panel door. U.S. Pat. No. 7,343,958 further discloses a drum construction which departs from a constant radius drum construction by providing a variable radius associated with the spiral cable groove of the drum. However, the variable radius construction of the drum is very limited in its aspects and features.

In contrast, an aspect of the present invention is the utilization of a cable drum having a spiral groove with two adjacent sections that are generally coaxial with the longitudinal axis of the cable drum in a counterbalanced, multi-panel garage door lifting mechanism. The groove or grooves in a first section adjacent the attachment end of the cable to the drum have a lesser radius than the remaining grooves of the second section of the drum which have substantially equal radii of greater diameter than the first section radii. As a consequence, initial force associated with lifting of a garage door is increased or greater which is very beneficial in the situation of a heavier upper or top panel or panels of a multi-panel garage door. Once having lifted the heavier panel, the greater or larger radii groove second section of the drum provides for lesser lifting torque or force and thus accommodates the lifting of the lesser weight remaining panels. The ratio of the lesser radii first drum section grooves to the remaining second section drum groove radii of the spiral groove of the drum is less than one (1) and the number of grooves of the lesser radii is based upon a ratio of the number of panels of heavier construction vis a vis the lighter construction panels.

As another aspect of the invention the lesser radii grooves of the drum are all substantially equal and the remaining second section radii grooves are substantially equal.

As a further aspect of the invention there is disclosed a drum construction for a counter balanced, horizontal multi-panel door lifting mechanism which is easy to manufacture, easily installed and easily incorporated into existing designs of garage door counter balance and lifting mechanisms.

These and other objects, advantages and features of the invention will be set forth in the detailed description which follows.

BRIEF DESCRIPTION OF THE DRAWING

In the detailed description which follows reference will be made to the drawing comprised of the following figures.

DETAILED DESCRIPTION OF EMBODIMENTS OF THE INVENTION

Figure 1:
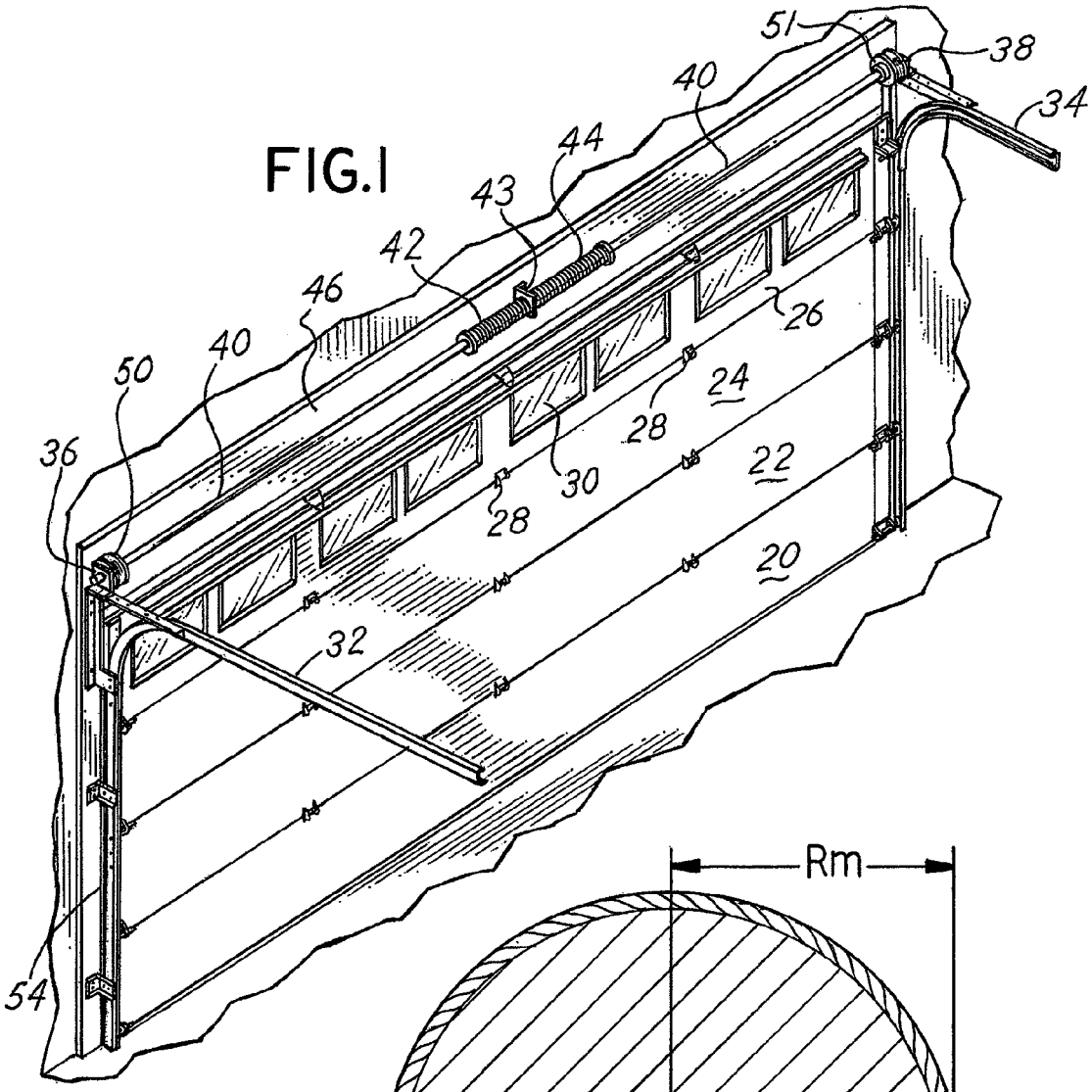
FIG. 1 is an isometric view of a typical multi-panel garage door construction wherein the upper panel is much heavier than the individual remaining panels and which results in a disproportionally heavier load upon the door lift mechanism when initially raising the door.

Referring the FIG. 1 there is depicted a typical multi-panel garage door construction or assembly. Multiple horizontal panels 20, 22, 24 and 26 are connected together by hinges, for example, hinge 28 to enable articulation of the panels 20, 22, 24, 26 due to movement along tracks 32, 34.

Figure 2:
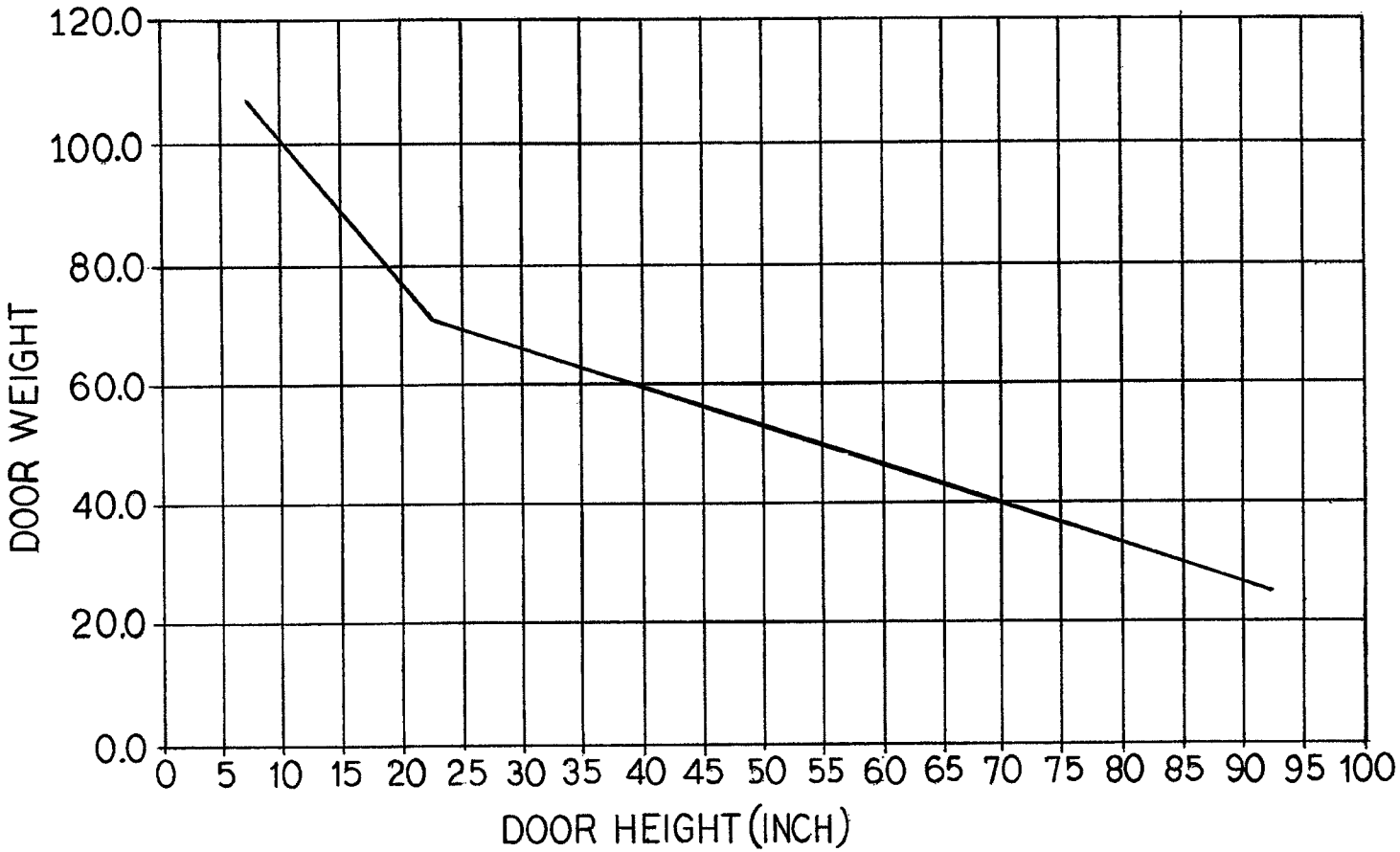
FIG. 2 is a graph depicting an example of an aspect of the invention wherein the typical weight in pounds of a multi-panel garage door varies with respect to the height thereof illustrating the change in load associated when raising the garage door via movement along a mounting track for the garage door.

The top panel 26 includes windows or glazing 30. Thus, the top panel 26 or top panel section 26 is heavier on a panel unit basis than each of the separate lower panels 20, 22 and 24 which each have a substantially equal or similar construction. As a consequence, increasing door height results in an increase of load or weight of the door. However, the rate of increase for the lower panels 20, 22, 24 is uniform whereas the heavier upper panel 26 provides a uniform, but higher rate of increase of panel weight. FIG. 2 is an example of a graph which illustrates the change in weight of door panels for a door generally of the type depicted in FIG. 1.

The door assembly or construction is mounted on parallel, spaced tracks 32 and 34 in a conventional manner. Thus rollers (not shown) associated with each of the panels 20, 22, 24, 26 enable the panels, which are connected and articulate with respect to each other, to move along the tracks 32 and 34 between a closed and an open position.

A cable assist lifting mechanism is also depicted in FIG. 1. It includes a rotatable horizontal rod or shaft 40 attached to torsion springs 42 and 44. The opposite ends of rod 40 are journaled in end brackets 36, 38 attached to header 46 of the door frame. A support bracket 43 is also attached to header 46 of the door frame for the door. The support bracket 43 rotatably supports rod 40 and also has one end of each torsion spring 42, 44 attached thereto. The opposite end of each torsion spring 42, 44 is attached to the rod 40. As the rod 40 rotates about its longitudinal axis in the mounting brackets 36, 38 attached to the door frame header 46, the torsion springs 42, 44 are torqued upon lowering of the door. Torque is released as the door is raised.

A drum 50, 51 is coaxially attached at each end of the rotatable rod 40 and a cable 54 is wound in a spiral groove 70 of each drum 50, 51. A free end of cable 54 is attached from each drum 50, 51 to the lower panel 20. The opposite end of each cable 54 is wound in the spiral groove 70 and attached thereto in a retention slot 78 of each drum 50, 51. Typically a motorized mechanical arm (not shown), which is movable along a center track, is attached to the top panel 26 to facilitate movement of the panels along the track 32, 34. The door by torque of springs 42 and 44 can thus be moved into the open position position.

Figure 3:
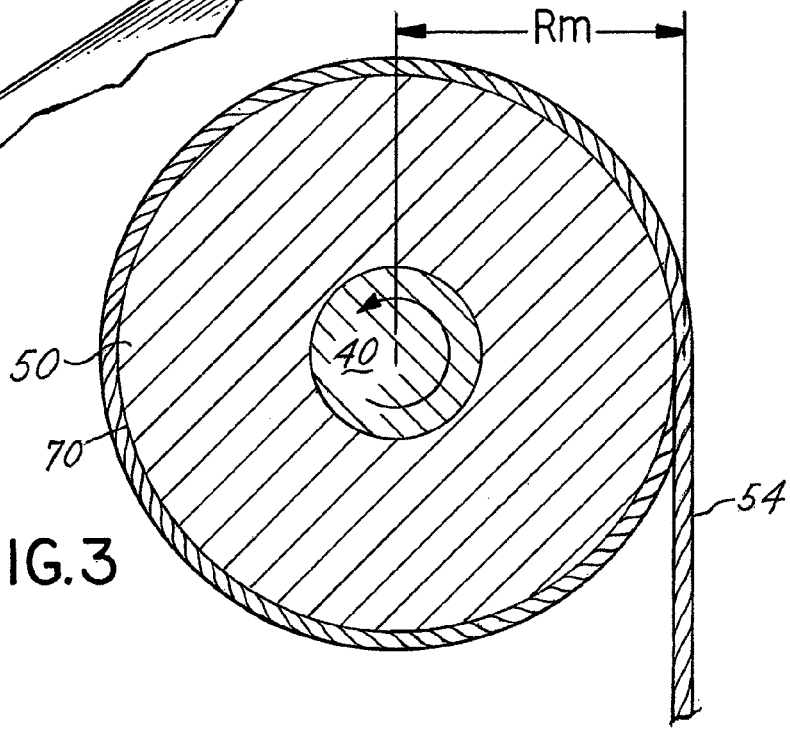
FIG. 3 is a cross-sectional view of a drum in accord with the subject matter of the invention.
Figure 5:
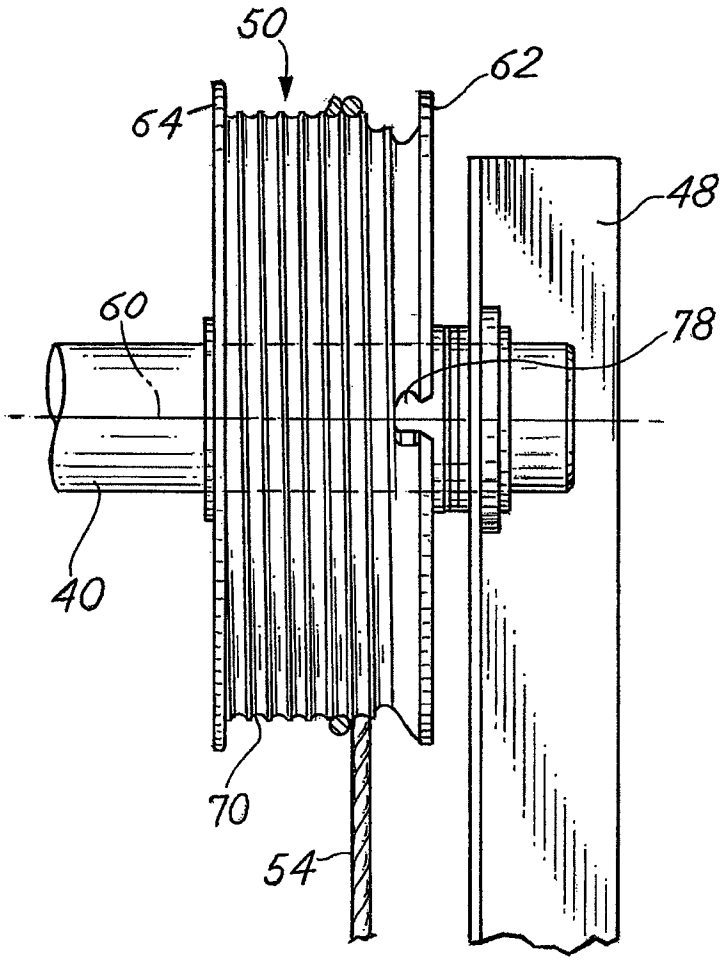
FIG. 5 is a front elevation view depicting the construction of an drum made in accord with the invention.
Figure 4:
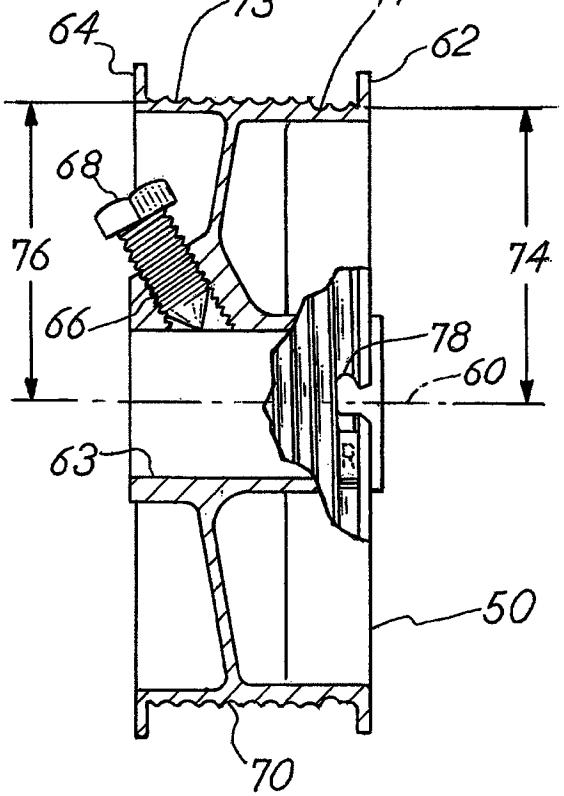
FIG. 4 is a further cross-sectional view of the drum of FIG. 4 depicting the radii associated with the spiral groove on the outer surface of the drum and the substantially constant radius of the outer or remaining grooves and the constant lesser radii of the inner or initial grooves.

The subject matter of the invention relates specifically to construction of the drums 50, 51 and is illustrated in greater detail in FIGS. 3, 4 and 5. Referring to those figures, each drum 50, 51 is generally configured as a cylindrical member and includes a longitudinal center line axis 60, an inner, radial flange 62 and an outer, radial flange 64. A hollow coaxial center-line passage 63 receives the mounting rod 40. A threaded set screw 68 in threaded passage 66 (or multiple set screws) may be provided to tightly fasten the drum 50 to the rod 40. The outer case of the drum 50 between the flanges 62 and 64 comprises the spiral groove 70. The spiral groove 70 is divided into two sections 71, 73. First section 71 has a lesser radial groove dimension 74 than the second section 73 radial groove dimension 76. Typically first radial dimension 74 is substantially equal over a number of turns, for example, two to three or more turns and is smoothly connected to a second section 73 which constitutes the remaining portion of the spiral groove 70. The second section 73 has a substantially uniform radial dimension 76 of the grooves at their minimum groove depth.

The lesser radial groove section 71 terminates at a cable attachment slot 78. Thus a cable 54 wound about the drum 50 will be attached at one end through the groove attachment slot 78, wound around the grooves 71, 73 and attached to the opposite end to the lower panel 20 of the collection of panels 20, 22, 24, 26 comprising the garage door construction.

The grooves 71 associated with the lesser radii section 74 are provided to accommodate the greater weight of the upper panel 26. The change in radius affects torque since the product of radius and force equals torque. Thus, the force associated with the connection and arrangement of those grooves 71 is greater than the force associated with the remaining grooves 73. The number of lesser radii grooves 71 relative to the remaining grooves 73 is a fraction less than one (1). The ratio of the lesser radial grooves 71 to the totality of grooves (71, 73) is a fraction less than one (1). This fraction may be calculated based upon the ratio by way of example of the weight and/or vertical dimension of the top panel 26 or a top portion of the door to the remaining panels 20, 22 and 24 or door portion. Additionally, the radius 74 of the lesser radial grooves 71 can be calculated using a similar comparative basis. In the circumstance of a door construction wherein the top panel has a greater height, the number of lesser dimension spiral grooves may increase in a proportional manner based upon the greater panel height. The invention, thus, accommodates horizontal panel weights (in terms of height or construction materials or both) which may vary in a linear fashion with the weight of the door having the greater proportionally of weight at the top of the closed door.

An example of this aspect of the invention demonstrates the concept. Thus, if a top door panel has a vertical height of 24 inches, and the circumference of the lesser radius grooves 71 is 12.5 inches, then two lesser radial dimension cable wraps 71 will be required in order to provide necessary additional torque to easily and smoothly move the 24 inch heavier top panel from a vertical to a generally horizontal position in the track 32, 34.

If, however, the heavier top panel is 32 inches in vertical height, then more than two cable wraps 71, having a 12.5 inch circumference in the example, will be required to move the 32 inch panel from a vertical to a generally horizontal position with the necessary torque. As a consequence, in this example, a drum 50 having grooves with a 12.5 inch diameter will employ or desirably incorporate at least three or more of the lesser radial grooves 71 to provide for a greater range or distance of higher torque travel. Thus a single size drum 50 may be used for multi panel doors having a heavier top panel or panels with a vertical height up to about 37.5 inches in this example.

The circumference or radial dimension of the lesser diameter grooves 71 and the number of such grooves is thus chosen to provide for adequate travel or winding of cable to lift a range of heights of heavier, upper panel or panels. The remaining grooves 73 will have a greater radius for lifting the remaining panel or panels. Nonetheless an adequate number of generally substantially lesser or equal radius (i.e., equal circumference) grooves 71 are desirably incorporated in a drum 50 to accommodate doors made up of a range of the vertical height of heavier, upper door panel(s). The remaining grooves will then have a greater radius or circumference. In review, with the described design a single size and configured drum can be used with door lift systems having a range of the vertical height of the heavier, upper panel or panels of a multi-panel door.

While there has been set forth a preferred embodiment of the invention, it is to be understood that the invention is to be limited only by the following claims and equivalents thereof.

What is claimed is:

1. A cable drum construction in combination with a counterbalanced door lifting mechanism lifting an articulated, multiple horizontal panel door assembly comprised of door panels having a top panel and one or more remainder panels, said top panel having a top panel height and proportionally heavier weight than the weight of one or more of said remainder panels, said top panel and remainder panels mounted in a door frame with a header, said combination comprising:

a rotatable shaft for mounting on said door frame;

a lift cable having a remainder panel attachment end and a drum attachment end; and a generally cylindrical drum body having a center line axis of rotation coaxially mounted on said shaft for rotation of said shaft and drum, said drum including a coaxial, external spiral groove for receipt of multiple windings of said lift cable, said spiral groove including a first section of multiple circumferential spiral groove winding slots for said lift cable, said first section including a cable retention element for attachment of said drum attachment end of said lift cable to said drum with said cable wound in selected groove winding slots of said first section, said spiral groove further including a second, exit section of spiral groove winding slots joined to said first section, said first section spiral groove winding slots all having substantially equal and lesser radii winding slots for said lift cable than the radii of the remaining second section spiral groove winding slots;

said first section lesser radii groove winding slots having in combination a total circumference dimension on said drum, said total circumference dimension of the lesser radii groove winding slots of the first section exceeding the top panel height to accommodate the proportionally heavier top panel and thereby provide greater torque relative to the radial groove winding slots of said second section of winding slots, said second section winding slots all having substantially equal radii greater than said first section winding slots, said lift cable exiting from said second section winding slots for attachment to a remainder panel.

2. The combination of claim 1 wherein the top panel includes glazing.

* * * * *